US008390539B2

(12) United States Patent
Kawasaki et al.

(10) Patent No.: US 8,390,539 B2
(45) Date of Patent: Mar. 5, 2013

(54) DRIVING CIRCUIT FOR LIGHT-EMITTING DEVICE AND DISPLAY APPARATUS

(75) Inventors: Somei Kawasaki, Saitama (JP); Kouji Ikeda, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 1199 days.

(21) Appl. No.: 12/235,052

(22) Filed: Sep. 22, 2008

(65) Prior Publication Data

US 2009/0085908 A1 Apr. 2, 2009

(30) Foreign Application Priority Data

Sep. 26, 2007 (JP) ..... 2007-249145

(51) Int. Cl.
*G09G 3/30* (2006.01)
*G09G 3/10* (2006.01)

(52) U.S. Cl. ..... 345/76; 345/77; 315/169.3

(58) Field of Classification Search ..... 345/76–83
See application file for complete search history.

(56) References Cited

U.S. PATENT DOCUMENTS

| | | | | |
|---|---|---|---|---|
| 5,302,871 | A | 4/1994 | Matsuzaki et al. | |
| 5,963,184 | A | 10/1999 | Tokunaga et al. | |
| 6,188,378 | B1 | 2/2001 | Yamamoto et al. | |
| 6,335,720 | B1 | 1/2002 | Mori et al. | |
| 6,348,910 | B1 | 2/2002 | Yamamoto et al. | |
| 6,373,454 | B1 | 4/2002 | Knapp et al. | 345/76 |
| 6,552,709 | B1 | 4/2003 | Yamaguchi | |
| 6,559,824 | B1 | 5/2003 | Kubota et al. | |
| 6,587,086 | B1 | 7/2003 | Koyama | |
| 6,661,180 | B2 | 12/2003 | Koyama | |
| 7,126,565 | B2 | 10/2006 | Kawasaki et al. | |
| 7,242,397 | B2 | 7/2007 | Iseki et al. | 345/204 |
| 7,253,812 | B2 | 8/2007 | Sasaki | |
| 7,259,735 | B2 | 8/2007 | Kasai | |
| 7,532,207 | B2 | 5/2009 | Kawasaki et al. | |
| 7,605,899 | B2 | 10/2009 | Shikina et al. | |
| 7,692,643 | B2 | 4/2010 | Kawasaki et al. | |
| 7,812,812 | B2 | 10/2010 | Yoshinaga et al. | |
| 7,817,116 | B2 * | 10/2010 | Kimura | 345/76 |
| 7,911,425 | B2 | 3/2011 | Goden et al. | |
| 2002/0047581 | A1 | 4/2002 | Koyama | |

(Continued)

FOREIGN PATENT DOCUMENTS

| | | | |
|---|---|---|---|
| CN | 1521719 | A | 8/2004 |
| CN | 1770246 | A | 5/2006 |

(Continued)

*Primary Examiner* — Sumati Lefkowitz
*Assistant Examiner* — David Tung
(74) *Attorney, Agent, or Firm* — Fitzpatrick, Cella, Harper & Scinto

(57) ABSTRACT

A driving circuit for a light-emitting device outputs a drive current from an output terminal to the light-emitting device in accordance with a signal current input from an input terminal. The driving circuit includes a drive transistor, a capacitor connected between a gate and a source of the driving transistor, and a resistance device and a first switch arranged in series between a drain of the drive transistor and the input terminal. In addition, a second switch is configured to connect the gate and the drain of the drive transistor through the resistance device when the first switch is closed, and a third switch is disposed in a path through which a drain current of the drive transistor flows from the output terminal to the light-emitting device. The resistance device increases its resistance in accordance with a cumulative amount of a passing current.

12 Claims, 9 Drawing Sheets

U.S. PATENT DOCUMENTS

| | | | | |
|---|---|---|---|---|
| 2003/0058687 | A1 | 3/2003 | Kimura | |
| 2004/0155843 | A1 | 8/2004 | Sasaki | |
| 2004/0183752 | A1 | 9/2004 | Kawasaki et al. | 345/20 |
| 2005/0007316 | A1 | 1/2005 | Akimoto et al. | |
| 2005/0007319 | A1 | 1/2005 | Shin et al. | |
| 2005/0041002 | A1 | 2/2005 | Takahara et al. | |
| 2005/0122150 | A1 | 6/2005 | Iseki et al. | 327/215 |
| 2005/0285151 | A1 | 12/2005 | Kawasaki | 257/213 |
| 2006/0061529 | A1 | 3/2006 | Kim | |
| 2006/0114194 | A1 | 6/2006 | Kawasaki et al. | 345/76 |
| 2006/0114195 | A1 | 6/2006 | Yamashita et al. | |
| 2006/0132395 | A1 | 6/2006 | Kawasaki et al. | |
| 2006/0187185 | A1 | 8/2006 | Yoshinaga et al. | |
| 2006/0267509 | A1* | 11/2006 | Yang | 315/169.3 |
| 2007/0132719 | A1 | 6/2007 | Yamashita et al. | |
| 2007/0257867 | A1 | 11/2007 | Kasai | |
| 2007/0257868 | A1 | 11/2007 | Kasai | |
| 2008/0007494 | A1 | 1/2008 | Kim et al. | |
| 2008/0157828 | A1 | 7/2008 | Kawasaki et al. | 327/108 |
| 2008/0158112 | A1 | 7/2008 | Kawasaki et al. | 345/76 |
| 2008/0259000 | A1 | 10/2008 | Kawasaki | 345/55 |
| 2009/0015571 | A1 | 1/2009 | Kawasaki et al. | |
| 2009/0033599 | A1 | 2/2009 | Kawasaki et al. | |
| 2009/0066615 | A1 | 3/2009 | Kawasaki | |
| 2009/0085908 | A1 | 4/2009 | Kawasaki et al. | |
| 2009/0102853 | A1 | 4/2009 | Kawasaki et al. | |
| 2009/0109144 | A1 | 4/2009 | Goden et al. | |
| 2009/0121980 | A1 | 5/2009 | Kawasaki et al. | |
| 2009/0135110 | A1 | 5/2009 | Nakamura et al. | |
| 2009/0231239 | A1 | 9/2009 | Goden et al. | |
| 2009/0289966 | A1 | 11/2009 | Ikeda et al. | |
| 2010/0026677 | A1 | 2/2010 | Shikina et al. | |
| 2010/0073267 | A1 | 3/2010 | Akimoto et al. | |
| 2010/0128160 | A1 | 5/2010 | Maru et al. | |
| 2010/0328365 | A1 | 12/2010 | Ikeda et al. | |
| 2011/0001689 | A1 | 1/2011 | Maru et al. | |
| 2011/0025653 | A1 | 2/2011 | Ikeda et al. | |
| 2011/0090210 | A1 | 4/2011 | Sasaki et al. | |

FOREIGN PATENT DOCUMENTS

| | | | |
|---|---|---|---|
| EP | 1 429 312 | A2 | 6/2004 |
| JP | 11-282417 | A | 10/1999 |
| JP | 2001-134229 | A | 5/2001 |
| JP | 2001-159877 | A | 6/2001 |
| JP | 2004-3411144 | A | 12/2004 |
| JP | 2005-157322 | A | 6/2005 |
| JP | 2006-030516 | A | 2/2006 |
| JP | 2008-268981 | A | 11/2008 |
| JP | 2008-015516 | A | 12/2008 |

* cited by examiner

DRIVING CIRCUIT FOR LIGHT-EMITTING DEVICE AND DISPLAY APPARATUS

BACKGROUND OF THE INVENTION

1. Field of the Invention

The present invention relates to a driving circuit for an electroluminescent device that receives a current and emits light (hereinafter referred to as an EL device) and to an active-matrix display apparatus that uses the driving circuit in displaying an image.

2. Description of the Related Art

Recently, a display apparatus using an EL device has attracted attention as a replacement for a display apparatus using a cathode ray tube (CRT) or a liquid crystal display (LCD). In particular, a current-controlled organic EL device, whose emission brightness is controlled by a current passing through the device, is being actively developed. Also being developed is a color display panel that includes many organic EL devices of three colors having different emission wavelengths aligned on a substrate with driving circuits.

A current-writing driving circuit, which is tolerant of variations in characteristics of used thin-film transistor (TFT) elements, is typically employed. In this case, a display signal supplied to a signal line is a current signal. FIG. 8 illustrates an example configuration of a current-writing driving circuit proposed in the specification of U.S. Pat. No. 6,373,454. In FIG. 8, an n-channel drive transistor described in the aforementioned specification is changed to a p-channel one. FIG. 9 is a timing chart of a control signal to be input to a driving circuit illustrated in FIG. 8 via scanning lines P1 and P2.

A driving circuit 1 illustrated in FIG. 8 outputs a drive current corresponding to an input current Idata to an EL device. The input current is received from a signal line "data" at the drain of a transistor M1. The drain of the transistor M1 is an input terminal of the driving circuit 1 for receiving a current signal. The drive current is supplied from the drain of a drive transistor M3 to the EL device. In FIG. 8, the drain of the drive transistor M3 via a switching transistor M4 is an output terminal of the driving circuit 1.

The driving circuit 1 further includes a switching transistor M2 for opening and closing between its drain and the drain of the drive transistor M3. The driving circuit 1 further includes the switching transistors M1 and M4. When the switching transistor M2 is on (it is closed as the switch), the switching transistor M1 is on and guides a signal current of the signal line data to the drain of the drive transistor M3. When the switching transistors M1 and M2 are off, the switching transistor M4 is on and passes a drain current of the drive transistor M3 through the EL device "EL" as a drive current. The switching transistors M1, M2, and M4 are current-path switching units configured to switch the passage of the drain current of the drive transistor M3 between a path for a signal current and a path for a drive current.

The driving circuit 1 is connected to a light emitting power source line PVdd, the signal line data, and the scanning lines P1 and P2. Writing operation and illuminating operation are performed on the driving circuit 1. In writing, P1 is H, P2 is L, the drive transistor M3 is in a diode-connected state, and a signal current Idata supplied from the signal line passes. In accordance with the magnitude of this current, a voltage occurs between the source and the gate, and a storage capacitor C1 is charged.

In illuminating, P1 is L, P2 is H, and the drain terminal of the drive transistor M3 is connected to the current-injected terminal (in this case, the anode terminal) of the EL device. Because the gate of the drive transistor M3 is separated from the drain, a voltage charged in the storage capacitor C1 in writing is maintained which is the gate voltage of the drive transistor M3. A current corresponding to it passes through the drain. The voltage of the storage capacitor C1 depends on a gate-source threshold voltage of the drive transistor M3 and the relationship between the drain current and the drain-source voltage (hereinafter referred to as the current-voltage characteristic). The drain current of the drive transistor M3 determined by the circuit is substantially the same as the signal current Idata because the difference between the threshold voltage and the current-voltage characteristic is negated. Therefore, the EL device is illuminated at brightness corresponding to the signal current Idata.

EL devices exhibit a deterioration phenomenon in which long-time illumination causes a decrease in brightness.

FIG. 4 illustrates a decrease in brightness of an EL device continuously driven at a constant current. The x axis indicates the illumination time, and the y axis indicates the display brightness. When the start time of illumination is 0, the brightness relatively sharply decreases from the initial brightness L0 to the brightness L1 up to the elapsed time T1. After the time T1, the brightness decreases gradually. The period up to the illumination time T1 is called an initial deterioration period, and the period thereafter is called a late deterioration period. For most EL devices, the initial deterioration period is short, so the initial deterioration can be eliminated by the execution of short-term aging. As a result, in many cases, such as a display panel, the late deterioration period starting from the illumination time T1 is used.

The way in which deterioration progresses depends on the length of an elapsed time and the magnitude of a current passing in the elapsed time. Because the degree of deterioration of a pixel illuminated for a long time and that of its surrounding pixel are different, even if a displayed image is switched to one in which these pixels have the same brightness, the long-time displayed image remains as a "burned-in" image which can be seen. In particular, for a digital camera or a portable device, each which have indications for, for example, capturing information, a clock, and various states, are displayed at one fixed position on the screen, so these displayed indications are likely to be "burned-in". "Burned-in" images are said to be identifiable even with a brightness difference of approximately 2%. Therefore, it is necessary that (L1−L2)/L1 be less than 2% where the product guarantee period is the period from T1 to T2, L1 is the brightness at the time T1 when the initial deterioration period elapses, and L2 is the brightness at the elapsed time T2.

However, it is difficult to make the decrease in the brightness of present EL devices less than 2% because their product guarantee periods vary from approximately to 100,000 hours. As a result, "burn-in" is a serious problem.

SUMMARY OF THE INVENTION

The present invention provides a driving circuit for a light-emitting device. The driving circuit outputs a drive current from an output terminal to the light-emitting device in accordance with a signal current input from an input terminal. The driving circuit includes a drive transistor, a capacitor connected between a gate and a source of the driving transistor, a resistance device and a first switch arranged in series between a drain of the drive transistor and the input terminal, a second switch configured to connect the gate of the drive transistor and a first terminal of the resistance device when the first switch is closed, the first terminal being more remote from the drive transistor, and a third switch disposed in a path through which a drain current of the drive transistor flows from the output terminal to the light-emitting device. The resistance device is configured to increase its resistance in accordance with a cumulative amount of a passing current.

According to an aspect of the present invention, an EL panel can be made in which deterioration caused by its illumination history of a light-emitting device of each pixel is reduced while a simple structure is used.

According to another aspect of the present invention, deterioration of a light-emitting device of each pixel can be compensated without having to use an external memory, such as random-access memory (RAM) or more expensive read-only memory (ROM). Consequently, the present invention can provide an EL panel whose deterioration is compensated and whose cost is not affected by an increase in the number of pixels with higher definition.

Further, without the need for external memory, the detection between terminals of an EL device and measurement of the current passing through the EL device do not need a deterioration detecting operation that can be unstable and that would require more time to apply the correct voltage. Therefore, an EL panel can be made that is capable of displaying a normal screen free from "burn-in" without causing a product user to see an EL deterioration phenomenon (burn-in) immediately after the power is turned on.

Further features of the present invention will become apparent from the following description of exemplary embodiments (with reference to the attached drawings).

DESCRIPTION OF THE EMBODIMENTS

Figure 1:
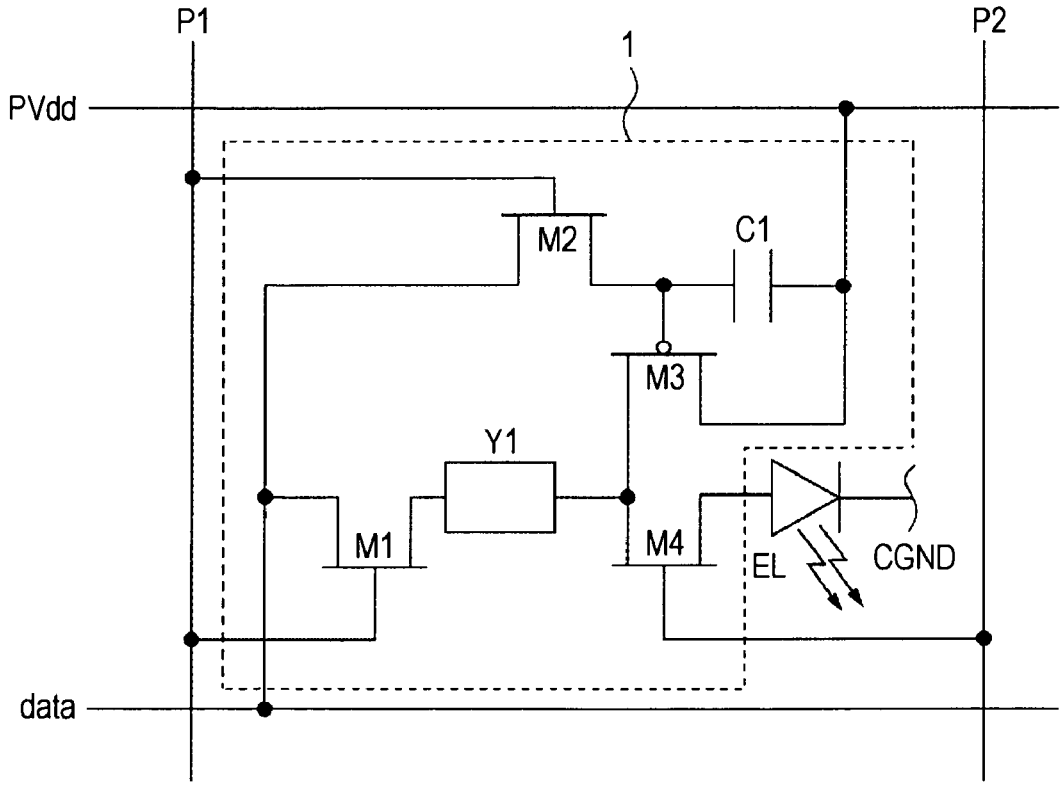
FIG. 1 illustrates a driving circuit according to a first embodiment of the present invention.

For a light-emitting device, its deterioration reduces the brightness and also changes (typically increases) the terminal voltage. In the driving circuit illustrated in FIG. 8, even when the terminal voltage of the EL device rises, the current passing through the EL device does not significantly change as long as the drive thin-film transistor (TFT) (M3) is in the saturated operation region. If the relationship between the current and the brightness does not change and the brightness is maintained constant to the same current, the brightness does not decrease even when the terminal voltage of the EL device changes. However, as previously described, the brightness of an organic EL device decreases with time even at a constant current, so maintaining the current constant is not sufficient to avoid decrease in brightness.

The present invention can be used in a display apparatus that employs an organic EL light-emitting device (hereinafter abbreviated as a light-emitting device). A decrease in brightness of the light-emitting device is used to determine and create a voltage change in a model device that simulates a deterioration. In accordance with that voltage change, a current passing through the light-emitting device is increased. When the current that is passing through a model EL device set for each driving circuit stays the same, increases, or decreases by a fixed factor, the voltage of the model device changes with the progression of deterioration of the light-emitting device. Passing a current compensated to a signal current through the light-emitting device in accordance with the voltage change of the model device enables the brightness to be maintained constantly to the signal current.

The model device is used within a driving circuit for each of the light-emitting devices of the display apparatus. The model device is a resistance device that has characteristics in which its resistance is raised by a continuously passing current, and thus, the voltage between terminals rises.

If the same drive current as that output from the driving circuit is passed through the resistance device, the same current as that passing through the light-emitting device is passed through the resistance device for the same period of time. Alternatively, if, while a signal current is written in the driving circuit, the same signal current passes through the resistance device, the same current as that passing through the light-emitting device passes through the resistance device for a period of time determined by the ratio of the writing time to the light-emitting time. In either case, because the cumulative amount of current proportional to the cumulative amount of current in the light-emitting device is present in the resistance device, the change in the resistance allows the amount of decrease in brightness of the light-emitting device to be determined. Thus the resistance device is a model of deterioration of the light-emitting device. Hereinafter, this resistance device is referred to as the deterioration model device.

The deterioration model device will be described next using specific examples.

Figure 3A:
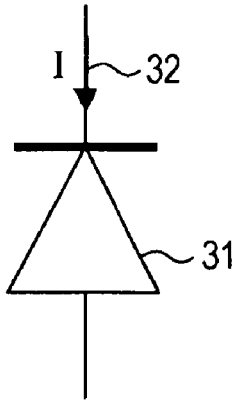
FIGS. 3A to 3C illustrate examples of a deterioration model device and a current-voltage characteristic.
Figure 3B:
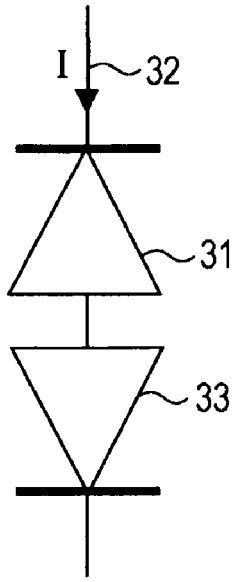
Figure 3C:
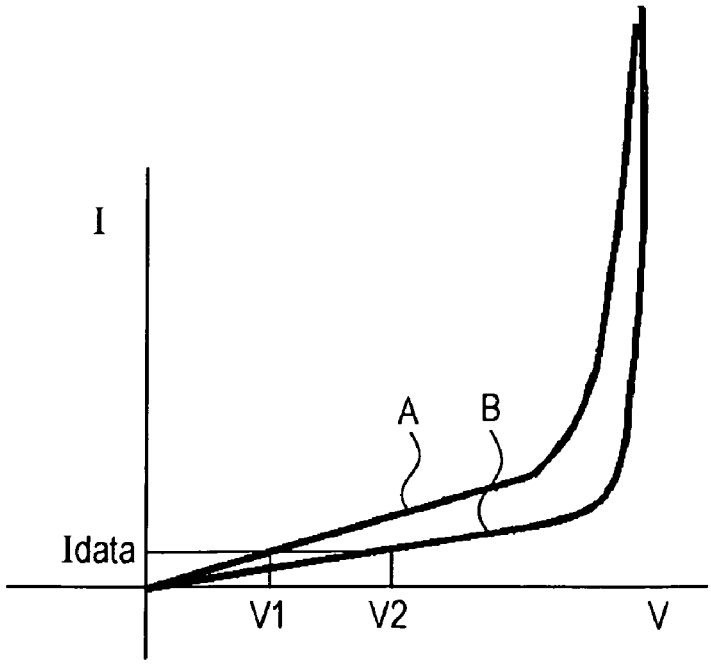
Figure 4:
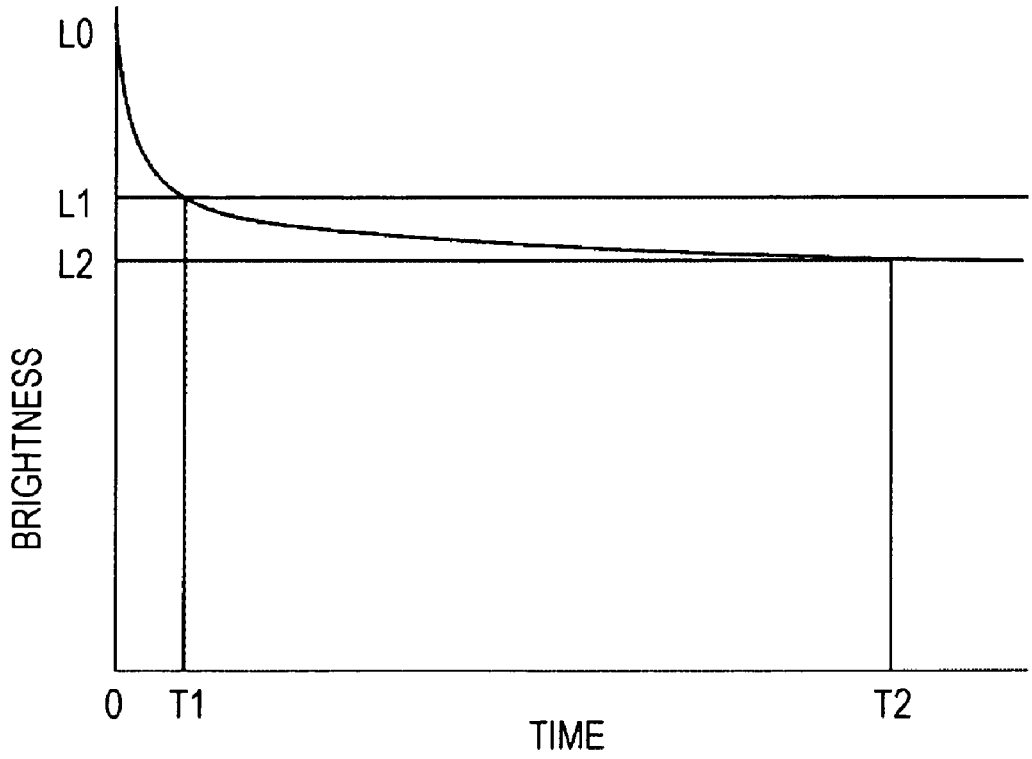
FIG. 4 illustrates the change in brightness of a light-emitting device driven at a constant current.

One example of a device whose terminal voltage changes with a cumulative amount of current (=current×time) is a reverse junction resistance of a p-n diode illustrated in FIG. 3A. When a reverse current I32 is passed through a p-n diode 31, a voltage V substantially proportional to the current occurs between the terminals. This current-voltage characteristic is shown in FIG. 3C. The current-voltage characteristic changes from A to B in FIG. 3C, whereas the voltage between the terminals increases from V1 to V2 to the same current Idata.

The arrangement illustrated in FIG. 3A can be used as the deterioration model device. An arrangement in which two p-n junction diodes 31 and 33 are connected in series in opposite directions, as illustrated in FIG. 3B, can also be used as the deterioration model device. The diode forward bias is negligible because it is significantly smaller than the reverse bias, so the current-voltage characteristic is also the one illustrated in FIG. 3C. The change in the current-voltage characteristic over time also occurs in a similar manner to that from A to B in FIG. 3C. That is, the two p-n junction diodes 31 and 33 connected in series in opposite directions can be considered as one deterioration model device. This is advantageous in that it can be used without consideration of a current direction, compared with the deterioration model device illustrated in FIG. 3A.

Because the driving circuit is formed from p-channel metal-oxide semiconductor (PMOS) and complementary metal-oxide semiconductor (CMOS) transistors, the p-n junction can be formed by the same manufacturing process as in the driving circuit. The magnitude of the terminal voltage can be adjusted by a change in a parameter of the p-n junction. The amount of change to the cumulative amount of current can be adjusted by use of the width of the p-n junction. When deterioration characteristics of the light-emitting device differ among R, G, and B, the width of the p-n junction may be set in accordance with their respective deterioration characteristics.

Best mode of the driving circuit for the light-emitting device according to an aspect of the present invention will be specifically described below with reference to the drawings.

First Embodiment

FIG. 1 illustrates a driving circuit according to a first embodiment of the present invention.

A driving circuit 1 illustrated in FIG. 1 receives a signal current Idata supplied to a signal line data as an input signal, converts it into a drive current, and supplies the drive current to a light-emitting device EL.

The signal current Idata is input to the driving circuit 1 by a transistor M1. The node where the source of the transistor M1 is connected to the signal line data is an input terminal of the driving circuit 1. The drive current to pass through the light-emitting device EL is supplied from the drain of a drive transistor M3. The drain of the drive transistor M3 is an output terminal of the driving circuit 1.

The driving circuit 1 illustrated in FIG. 1 includes the drive transistor M3, a capacitor C1 connected between the gate and the source of the drive transistor M3, the transistor M1 serving as a first switch, a transistor M2 serving as a second switch, and a transistor M4 serving as a third switch. A resistance device Y1 connected in series to the transistor M1 is disposed between the drain of the drive transistor M3 and the signal line data.

In FIG. 1, the transistor M2 is disposed between the gate of the drive transistor M3 and the source of the transistor M1 (the terminal connected to the signal line data). The second switch is a switch for making the same potential by connecting the gate of the drive transistor M3 and a first terminal of the resistance device Y1 when the transistor M1 is in an on state and the first switch is closed, the first terminal being more remote from the drive transistor M3. Accordingly, the transistor M2 may be disposed between the gate of the drive transistor M3 and the drain of the transistor M1 (the terminal connected to the resistance device Y1).

The transistor M4 is disposed between the drain of the drive transistor M3 and the light-emitting device EL and serves as the third switch guiding a drain current of the drive transistor M3 to the light-emitting device EL as a drive current when being closed. The third switch may be disposed at any location in a path for the drive current. For example, the third switch may be disposed downstream of the light-emitting device EL.

Figure 8:
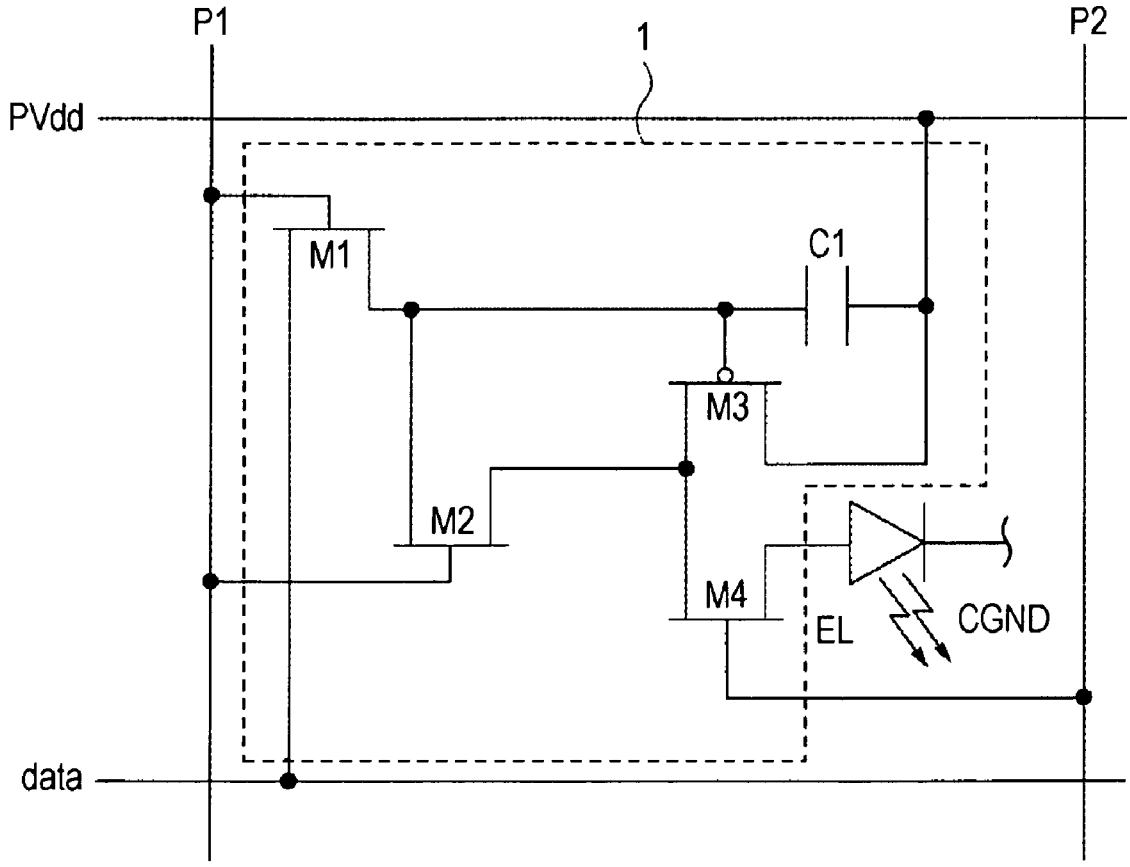
FIG. 8 illustrates a driving circuit for a known light-emitting device.
Figure 9:
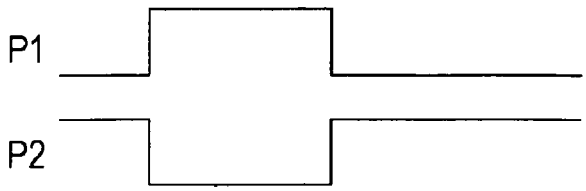
FIG. 9 is a timing chart of a scanning signal used in FIGS. 1, 6, 7, and 8.

The driving circuit 1 in FIG. 1 differs from the driving circuit illustrated in FIG. 8 in that the resistance device Y1 having two terminals is disposed between the drain of the drive transistor M3 and the drain of the switching transistor M1.

The resistance device Y1 is a deterioration model device. Either one of the deterioration model device illustrated in FIG. 3A and that in FIG. 3B may be used as the resistance device Y1. Because a current signal passes through the resistance device Y1 when being written, the same current as a drive current for the light-emitting device EL passes through the resistance device Y1 for a period of time determined by the ratio of the writing time to the EL light-emitting time. A cumulative amount of current proportional to the cumulative amount of current in the light-emitting device EL is present in the resistance device Y1. Therefore, the change in the resistance allows the amount of decrease in brightness of the light-emitting device EL to be determined. That is, the resistance device Y1 functions as a deterioration model device.

Figure 5:
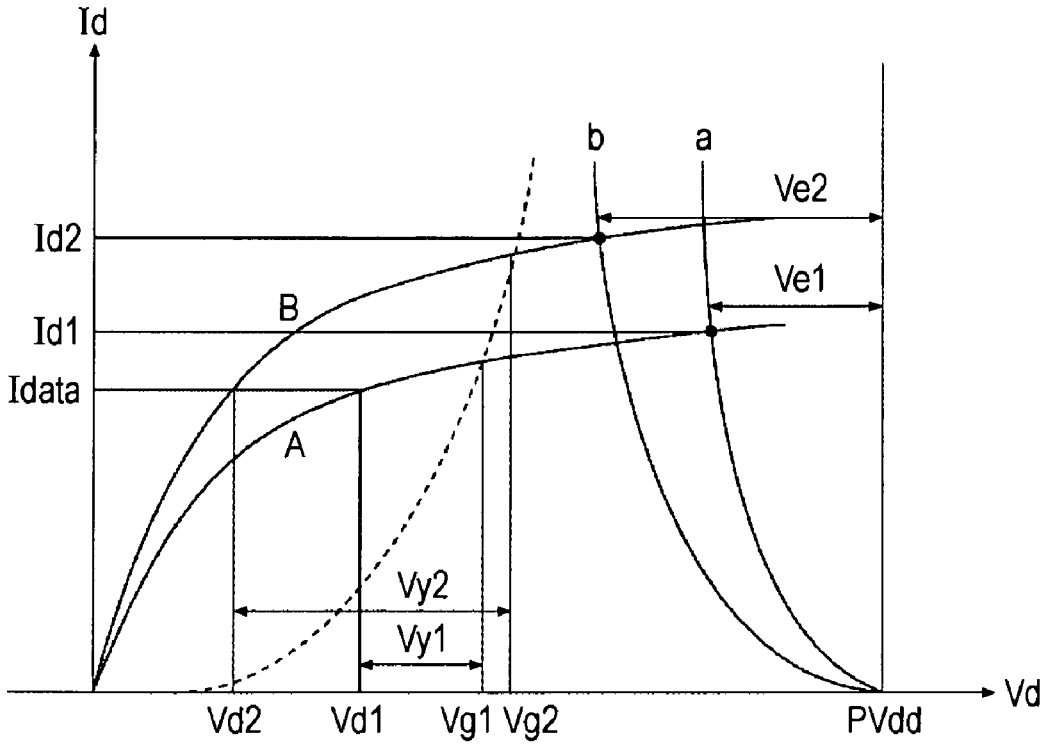
FIG. 5 is an illustration describing how the driving circuit operates according to the first embodiment.

Operation of the driving circuit illustrated in FIG. 1 will be described below by use of FIGS. 2 and 5. FIG. 5 illustrates the relationship between the drain-source voltage Vd (hereinafter referred to as a drain voltage) and the drain current Id (being positive in a direction from the source to the drain) where the gate-source voltage Vg of the drive transistor M3 (hereinafter referred to as a gate voltage) is a parameter. In FIG. 5, the gate-source voltage Vg is plotted as its absolute value although the value of the gate-source voltage Vg is negative, and the drain-source voltage Vd is also plotted as its absolute value.

Figure 2A:
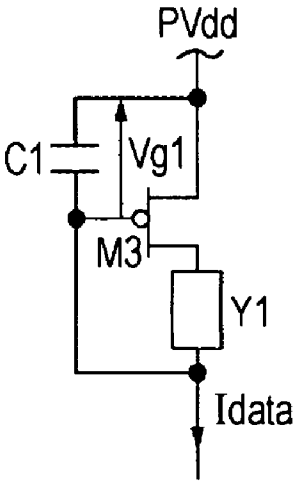
FIGS. 2A to 2D are illustrations describing how the driving circuit shown in FIG. 1 operates.

FIG. 2A illustrates an equivalent circuit for a current setting (writing) period in an initial state (the state immediately after the device is produced or the state after the initial deterioration; the same definition applies to the description below).

The deterioration model device Y1 is in a state in which it is free from "deterioration" caused by a current. The voltage between the terminals occurring when the signal current Idata passes through is an initial value Vy1. During a writing period, a first terminal of the two terminals of the deterioration model device is connected to the gate of the drive transistor M3, the first terminal being opposite to a second terminal connected to the drain terminal of the drive transistor M3. Therefore, the drain voltage Vd1 and the gate voltage Vg1 of the drive transistor M3 are determined according to the signal current Idata and have the relationship given by:

$$Vg1-Vd1=Vy1(I\text{data})$$

The curve A in FIG. 5 represents the relationship between the drain voltage and the drain current at the gate voltage Vg1.

Figure 2B:
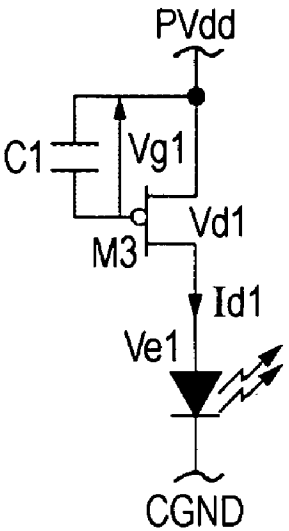

FIG. 2B illustrates an equivalent circuit for an illumination period in the initial state. Even when the state moves to the illumination period, the gate voltage Vg1 is not changed. The drive transistor M3 operates in accordance with the curve A illustrated in FIG. 5.

The curve "a" in FIG. 5 represents a characteristic of the light-emitting device EL. The reason why the curve a starts from the power supply voltage PVdd and curves toward a negative direction of Vd is to indicate in FIG. 5 that the sum of the voltage of the terminals of the light-emitting device EL and the drain voltage Vd of the drive transistor M3 is equal to the power supply voltage.

When the terminal voltage of the light-emitting device EL to the signal current Idata is Ve1, the drain voltage of the drive transistor M3 is Vd=(PVdd−Ve1). Because the drive transistor M3 operates in accordance with the curve A in FIG. 5, a current Id1 on the curve A determined by the aforementioned voltage Vd is injected into the light-emitting device EL.

Figure 2C:
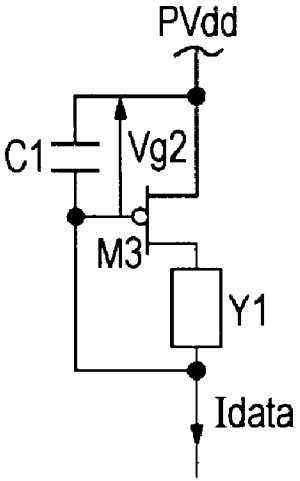

FIG. 2C illustrates an equivalent circuit for a writing period in a state in which the cumulative illumination brightness (=brightness×time) becomes large and thus the light-emitting device EL deteriorates.

At this time, "deterioration" caused by current is present in the deterioration model device Y1. As a result, the voltage Vy2 between the terminals occurring when the signal current Idata passes through is larger than the initial value. At this time, because the same signal current Idata passes, the gate voltage Vg2 of the drive transistor M3 is larger than the gate voltage Vg1, whereas the drain voltage Vd2 is smaller than the drain voltage Vd1. They have the relationship given by:

$$Vg2-Vd2=Vy2(I\text{data})$$

The curve B in FIG. 5 represents the relationship between the drain voltage and the drain current at the gate voltage Vg2. The values of the gate voltage Vg2 and the drain voltage Vd2 are represented as the points on the curve B.

Accordingly, the provision of the deterioration model device Y1 between the gate and the source of the drive transistor M3 enables an increase in the voltage between the terminals of the deterioration model device Y1 to be reflected to the gate voltage of the drive transistor M3, i.e., the voltage of the storage capacitor.

Figure 2D:
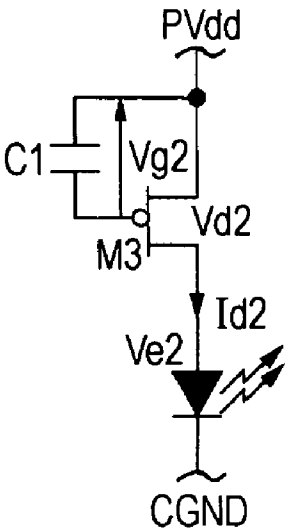

FIG. 2D illustrates an equivalent circuit for an illumination period in the deterioration state. The voltage between the terminals of the light-emitting device EL is increased by the deterioration and is represented by the curve b in FIG. 5. The intersection of the curves B and b is the operating point in the illumination period. The voltage between the terminals of the light-emitting device EL is given by Ve2, and the drain potential of the drive transistor M3 is Vd=(PVdd−Ve2). The current Id2 at the intersection passes through the light-emitting device EL.

Because the gate voltage Vg of the drive transistor M3 is larger than that in the initial state, the current Id2 passing through the light-emitting device EL is larger than the current Id1 in the initial state. This is a change of a direction in which decrease in brightness of the light-emitting device is compensated. The increase in the gate voltage Vg results from the increase in the voltage Vy between the terminals of the deterioration model device. Therefore, a brightness decrease can be negated by adjustment of a change over time in the voltage between the terminals of the deterioration model device so as to match with a change over time in the brightness of the light-emitting device.

The ratio Id2/Id1 of current of the light-emitting device subsequent to deterioration to that prior thereto when the voltage change Vy2−Vy1 of the deterioration model device is fixed is a parameter that indicates the deterioration compensating performance of the drive transistor M3. This ratio depends on the conductance of the drive transistor M3, and thus, it can be changed by changing the design.

The slope of the drain current in the saturated region of the drive transistor M3 and the increase in the voltage between the terminals of the light-emitting device are factors to reduce the deterioration compensating performance. They can be accommodated by an increase in the voltage change of the deterioration model device as long as the slope of the drain current is not extremely large.

In the driving circuit according to the present embodiment, a current is supplied to the deterioration model device Y1 only for a writing period. Therefore, the cumulative value of current in the deterioration model device and that in the light-emitting device are significantly different. In the case of a QVGA display panel having 262.5 scanning lines, the ratio of cumulative current amount in the deterioration model device to that in the light-emitting device is 1/261.5. In this case, the deterioration model device is set so as to "deteriorate" faster than the brightness change of the light-emitting device by 261.5 times. That is, it is necessary that the voltage change is adjusted to be large in accordance with this magnification.

Second Embodiment

Figure 6:
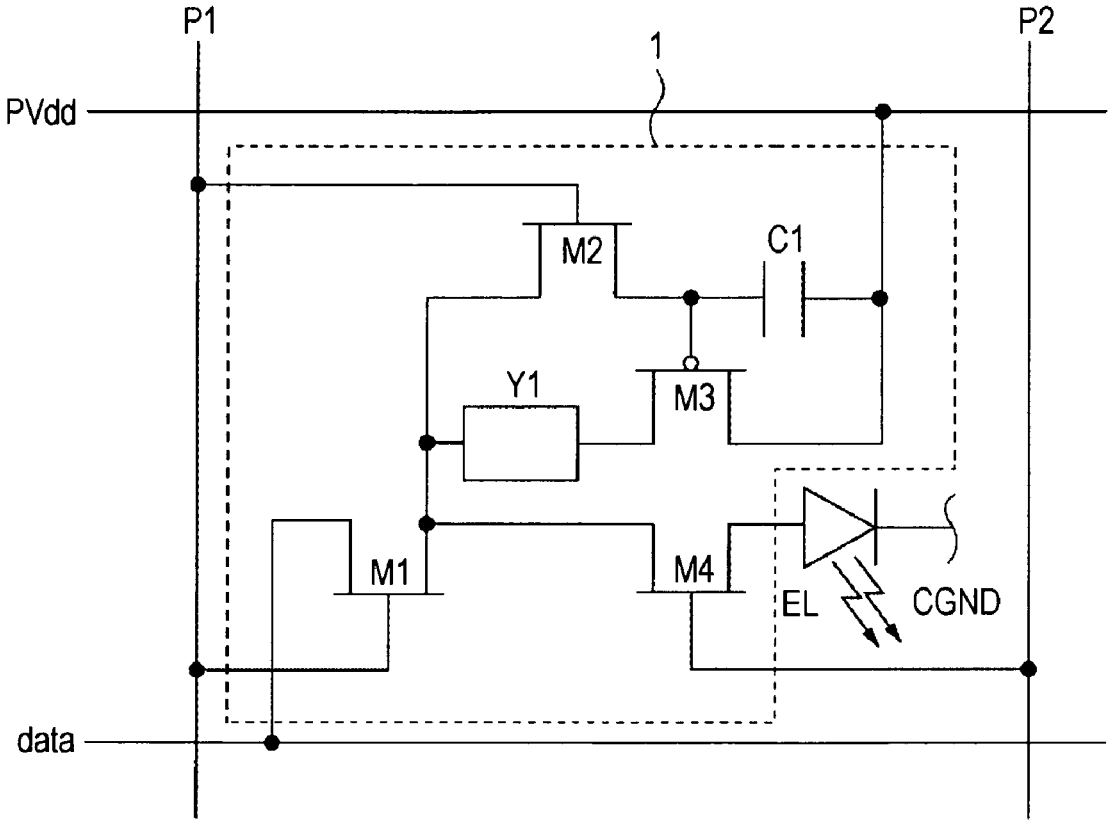
FIG. 6 illustrates a driving circuit according to the second embodiment of the present invention.

FIG. 6 illustrates a driving circuit according to a second embodiment of the present invention. This driving circuit differs from that illustrated in FIG. 1 in that the transistor M4 is disposed between the light-emitting device EL and the node between the deterioration model device Y1 and the switching transistor M1. Therefore, a drive current flows into the light-emitting device EL through the deterioration model device. Either of the deterioration model device illustrated in FIG. 3A and that in FIG. 3B can be used as the deterioration model device Y1.

Operation in a writing period is the same as in the first embodiment. In an illumination period, a current passes in series through the deterioration model device and the light-emitting device EL. Therefore, the curves a and b in FIG. 5 are replaced with a current-voltage characteristic of a circuit in which the light-emitting device EL and the deterioration model device are connected in series. However, the gate voltage of the drive transistor M3 after deterioration increases by the same amount as in the first embodiment. As a result, because the EL current increases remain unchanged, when compared to the first embodiment, similar compensating effects are obtainable.

The deterioration model device Y1 is disposed in both a path for signal current and a path for drive current. Therefore, the same current passes through the deterioration model device Y1 and the light-emitting device EL for the most part of a period of time, so substantially the same cumulative amount of current is present therein. As a result, unlike the first embodiment, it is unnecessary to adjust the deterioration speed by use of current time duty.

Third Embodiment

Figure 7:
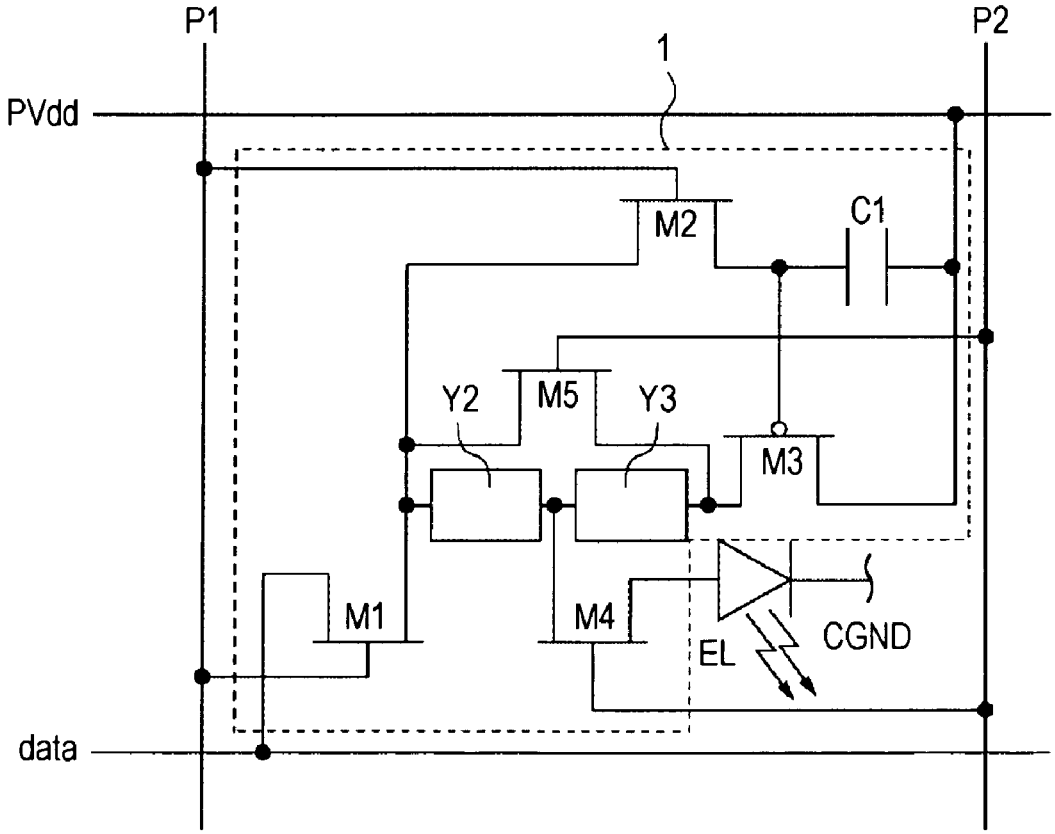
FIG. 7 illustrates a driving circuit according to the third embodiment of the present invention.

FIG. 7 illustrates a driving circuit according to a third embodiment of the present invention.

The resistance device described with reference to FIG. 3B is disposed between the drain of the drive transistor M3 and the node between the switching transistors M1 and M2. Specifically, an arrangement in which two diodes Y2 and Y3 are connected in a forward direction from the node toward both terminals is the deterioration model device in the present embodiment. The node between the diodes Y2 and Y3 is connected through the transistor M4 to the light-emitting device EL.

Of the diodes Y2 and Y3, the diode Y2 is more remote from the drive transistor M3. The diode Y2 is connected in a direction opposite to a signal current path. A signal current passes through the diode Y3, which is more adjacent to the drive transistor M3, in the forward direction. The diode Y2 is the one in which its voltage between the terminals changes in accordance with a cumulative amount of signal current.

A transistor M5 is connected to both ends of the deterioration model device Y2+Y3. In the circuit illustrated in FIG. 7, the transistor M5 is a forth switch, whereas the transistor M1 is the first switch, the transistor M2 is the second switch, and the transistor M4 is the third switch. The transistor M5 short-circuits both ends of the deterioration model device Y2+Y3 when a drive current passes through the light-emitting device EL. Therefore, the drain current of the drive transistor M3 passes through both the diodes Y2 and Y3 in the forward direction and is supplied from the intermediate node, i.e., the node between the diodes Y2 and Y3 to the light-emitting device EL. For the circuit in the second embodiment, a drive current of the light-emitting device passes through the reverse diode having a large resistance. Therefore, the power supply voltage PVdd is high correspondingly, and power consumption is large. In contrast, with the circuit in the present embodiment, a drive current passes through the two diodes in the forward direction, so power consumption is small. When there is no transistor M5, a drive current passes through only the diode Y3 in the forward direction. Also in this case, power consumption is smaller than that in the second embodiment.

The device illustrated in FIG. 3B can be used as each of the diodes Y2 and Y3 of the deterioration model device illustrated in FIG. 7. In this case, power consumption is the same as that in the second embodiment. However, because deterioration progresses for the same time period as in the passage of current through the light-emitting device, it is unnecessary to adjust the deterioration speed by use of current time duty.

Fourth Embodiment

Figure 10:
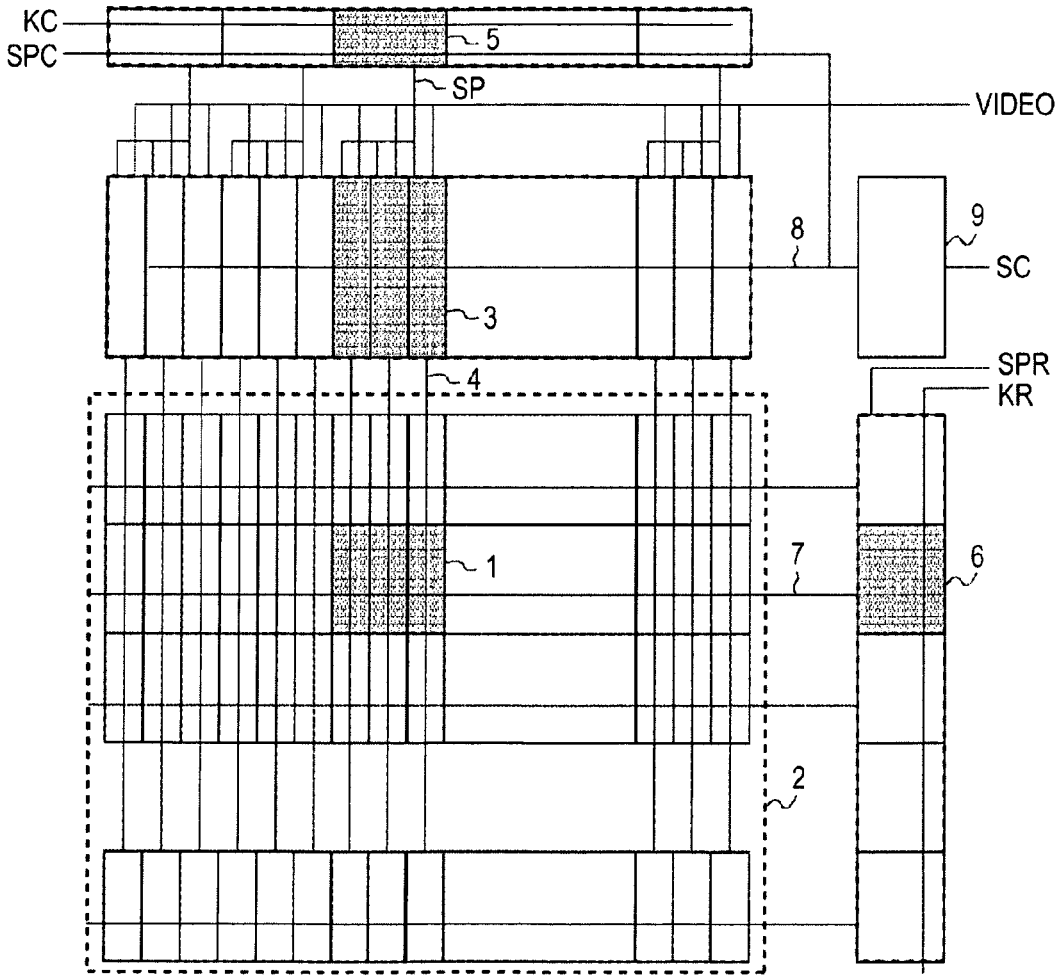
FIG. 10 is a block diagram of a color EL display apparatus according to the fourth embodiment of the present invention.

FIG. 10 is a block diagram that illustrates a general configuration of a color display panel that employs an organic EL device according to a fourth embodiment of the present invention.

In a display region 2, pixels are arranged in a matrix with rows (horizontally in FIG. 10) and columns (vertically in FIG. 10). In each pixel, an organic EL light-emitting device (not shown in FIG. 10) and the driving circuit 1 illustrated in FIG. 1 and described in the first embodiment are arranged. To display images in color, each pixel is made up of a combination of EL devices for three primary colors R, G, and B and three sub-pixels for driving these devices. The EL devices arranged in the same column correspond to the same color. The EL devices for three primary colors RGB are arranged in units of three columns.

The driving circuit 1 is connected to a signal line 4 for a corresponding column and a scanning line 7 for a corresponding row. A control signal from the scanning line 7 selecting a row causes the driving circuit 1 for the selected row to capture a display signal supplied to the corresponding signal line 4. When the control signal from the scanning line moves to the next row, each driving circuit 1 illuminates its associated EL device at the brightness corresponding to the captured display signal.

A control signal supplied through each of the scanning lines 7 is generated by a row register 6 including register blocks for receiving a row clock KR and a row scanning start signal SPR. The number of the row registers 6 is the same as the number of the rows.

A display signal to be supplied to the signal lines 4 is generated by column control circuits 3 arranged for the columns of the EL devices. The number of the column control circuits 3 is the same as the number of the columns. Each of the column control circuits 3 is composed of three systems of R, G, and B. An image signal VIDEO for a corresponding color is input to each system of the column control circuit 3. The column control circuit 3 generates a display signal in synchronization with a sampling signal SP shared by RGB and a horizontal control signal 8 and supplies it to the signal line 4 at a corresponding column.

A horizontal synchronization signal SC corresponding to the image signal VIDEO is input to a control circuit 9. The control circuit 9 generates the horizontal control signal 8. The sampling signal SP is generated by a column register 5 including registers whose number is one third of the number of the column control circuits 3. A column clock KC, a column scanning start signal SPC, and the horizontal control signal 8 used for mainly performing reset operation for the column register are input to the column register 5.

When displaying a test image continues, the voltage of the deterioration model device Y1 changes depending on the cumulative amount of current in each of the light-emitting devices. Because the drive current differs among pixels, the amount of change in the voltage differs among the deterioration model device. As a result, if the whole screen is made white after a set period of time elapses, the whole screen has a uniform emission brightness. Therefore, the test image is not identified as burned-in.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Application No. 2007-249145 filed Sep. 26, 2007, which is hereby incorporated by reference herein in its entirety.

What is claimed is:

1. A driving circuit for a light-emitting device, said driving circuit outputting a drive current from an output terminal to said light-emitting device in accordance with a signal current input from an input terminal, said driving circuit comprising:

a drive transistor;

a capacitor connected between a gate and a source of said driving transistor;

a resistance device and a first switch arranged in series between a drain of said drive transistor and said input terminal;

a second switch configured to connect said gate and said drain of said drive transistor through said resistance device when said first switch is closed; and a third switch disposed in a path through which a drain current of said drive transistor flows from said output terminal to said light-emitting device, wherein said resistance device is configured to increase its resistance in accordance with a cumulative amount of a passing current.

2. The driving circuit for a light-emitting device according to claim 1, wherein said output terminal from which said drive current is outputting is said drain of said drive transistor.

3. The driving circuit for a light-emitting device according to claim 1, wherein said resistance device comprises a p-n junction diode that passes the signal current and the drive current in opposite directions.

4. The driving circuit for a light-emitting device according to claim 1, wherein said resistance device comprises two p-n junction diodes connected in series in opposite directions.

5. The driving circuit for a light-emitting device according to claim 1, wherein said resistance device includes an intermediate node, and said output terminal from which said drive current is outputting is said intermediate node of said resistance device.

6. The driving circuit for a light-emitting device according to claim 5, further comprising:

a fourth switch configured to short-circuit terminals of said resistance device.

7. The driving circuit for a light-emitting device according to claim 5, wherein said resistance device comprises two p-n junction diodes connected in series facing both terminals from said intermediate node.

8. A display apparatus comprising combinations arranged in rows and columns, each of the combinations being composed of a light-emitting device and a driving circuit for supplying a drive current from an output terminal to said light-emitting device, said display apparatus further comprising scanning lines for selecting at least one of said driving circuits on a row-by-row basis and signal lines each for supplying a signal current from an input terminal to said selected driving circuit, wherein each of said driving circuits comprises:

a drive transistor;

a capacitor connected between a gate and a source of said driving transistor;

a resistance device and a first switch arranged in series between a drain of said drive transistor and said input terminal;

a second switch configured to connect said gate and said drain of said drive transistor through said resistance device when said first switch is closed; and a third switch disposed in a path through which a drain current of said drive transistor flows from said output terminal to said light-emitting device, wherein said resistance device is configured to increase its resistance in accordance with an increase in a cumulative amount of current.

9. A method of operating a driving circuit that outputs a drive current to a light-emitting device in accordance with a signal current input at an input terminal, the driving circuit having a drive transistor, a resistance device and a first switch, and a second switch disposed in a path through which a drain current of the drive transistor flows to the light-emitting device, the method comprising:

arranging the resistance device and the first switch in series between a drain of the drive transistor and the input terminal;

applying a signal current to the input terminal; and increasing a resistance of the resistance device in accordance with a cumulative amount of current passing through the resistance device.

10. A method of making a driving circuit that outputs a drive current to a light-emitting device in accordance with a signal current input at an input terminal, the method comprising:

providing a drive transistor;

arranging a resistance device and a first switch in series between a drain of the drive transistor and the input terminal, the resistance device having a characteristic that increases its resistance in accordance with a cumulative amount of a passing current; and providing a second switch disposed in a path through which a drain current of the drive transistor flows to the light-emitting device.

11. The method according to claim 10, wherein the resistance device is a p-n junction diode that passes a signal current and a drive current in opposite directions.

12. The method according to claim 10, wherein the resistance device is two p-n junction diodes connected in series in opposite directions.

* * * * *